US005996705A

United States Patent [19]

Downs

[11] Patent Number: 5,996,705

[45] Date of Patent: Dec. 7, 1999

[54] POWER TRENCHER

[76] Inventor: Alan C. Downs, 2604 Mountain Woods Dr., Birmingham, Ala. 35216

[21] Appl. No.: 08/888,947

[22] Filed: Jul. 7, 1997

Related U.S. Application Data

[60] Provisional application No. 60/021,292, Jul. 8, 1996.

[51] Int. Cl.[6] ..... B25D 9/04

[52] U.S. Cl. ..... 172/371; 175/19; 173/91

[58] Field of Search ..... 37/379; 172/329, 172/371, 41; 175/19; 173/90, 91; 111/115; 294/50.8, 50.9

[56] References Cited

U.S. PATENT DOCUMENTS 5,826,668 10/1998 Kosmalski ..... 172/19

*Primary Examiner*—David Bagnell
*Assistant Examiner*—Zakiya Walker
*Attorney, Agent, or Firm*—Mark E. Ogram P.C.

[57] ABSTRACT

A trenching tool which includes a lower portion having a blade and a guide tube. The guide or alignment tube is vertically positioned on one edge of the blade. An impact rod slips into the alignment tube and is repeatedly forced, by the operator, to impact the top of the blade, thereby driving the blade into the ground. Through a rocking motion, the channel formed by the blade is widened and the blade is again forced into the ground until the desired depth is obtained. The assembly is then removed and repositioned to extend the channel through the same procedure. The blade has either a rectangular cross section or a triangular cross section permitting the channel to be sloped automatically while the blade is being driven into the soil. A handle, preferably having shock absorption capabilities, allows the operator to slide the impact rod to obtain the driving force. A flexible harness keeps the impact rod from being withdrawn from the alignment tube; and, a pair of handles located on the alignment tube are used to reposition the assembly. In one embodiment of the invention, a plate at the top of the blade prevents the blade from being driven too deeply into the soil; another embodiment allows the plate to be positioned along the face of the blade to provide a depth limiting gauge.

22 Claims, 6 Drawing Sheets

POWER TRENCHER

This application claims benefit of provisional patent application Ser. No. 60/021,292, filed Jul. 8, 1996, and entitled "Power Trencher".

BACKGROUND OF THE INVENTION

This invention relates generally to trenching tools and more particularly to impact tools used to bury cables, wires, and the like.

This invention concerns an impact tool useful in the operation of burying cables, wires and other materials. It arises from the fact that fuel powered conventional burial machinery is not always practical in the commission of burying cables or wires.

Historically, the alternative tools used in the commission of burying cables or wires have been and are primitive, unsophisticated, and designed for a broad spectrum of uses and not specifically for the operation of burying cables or wires.

Such tools as shovels, picks and axes are also extremely inaccurate and potentially dangerous to the operator in the commission of burying cables or wires. Further, these tools provide extended or extremely wide trench when only a single wire or pipe needs to be buried.

Trenches made by shovels are also very disruptive to the ground and require an extended period of time for the lawn to grow over the site.

Further, the very nature of a shovel requires that the dirt be "removed", requiring that the removed dirt be placed somewhere until such time that the trench needs to be refilled. This is unsightly, causes damage to grass under the piles of removed dirt, and also creates a safety hazard (i.e. tripping or falling into the open trench).

It is clear there is a need for an improved trenching tool which will easily implant cables, wires, and other such materials.

SUMMARY OF THE INVENTION

The invention provides a trenching tool which includes a lower portion having a blade and a guide tube. In this context, the guide or alignment tube is secured to the blade along one edge of the blade. Gussets or supports are provided which further strengthen the bond between the alignment tube and the blade.

The alignment tube is open to the top of the blade. In some embodiments, an impact point or plate is provided which assists in transferring force directly into the top edge of the blade.

This force is provided by an impact rod which slips into the alignment tube and is repeatedly forced, by the operator, to impact the top of the blade, thereby driving the blade into the ground. In practice, the user lifts the impact rod and slams it down through the alignment tube to impact the top of the blade. The impacting force causes the blade to be driven into the soil.

Through a rocking motion, the channel formed by the blade, is widened and the blade is again forced into the ground until the desired depth is obtained.

Note that no excess dirt is removed from the site and only a narrow channel is formed.

The assembly (blade and impact rod) is then removed and repositioned to extend the channel through the same procedure. Through this repetitive procedure a channel is easily formed which readily accepts a wire (i.e for telephone, cable television, irrigation system control wires) or a single pipe (i.e. for a single pipe for a watering system).

The blade has either a rectangular cross section or a triangular cross section permitting the channel to be sloped automatically while the blade is being driven into the soil. In one embodiment of the invention, a gauge is imprinted onto the side of the blade to indicate the depth which has been acquired.

A handle, preferably having shock absorption capabilities, allows the operator to slide the impact rod to obtain the driving force. The preferred handle is a cross handle arrangement which fits through a shock absorbing mechanism at the top of the impact rod. The handle arrangement permits the impact rod to be manually raised and then slammed down onto the top of the blade.

As a safety feature, a flexible harness keeps the impact rod from being withdrawn from the alignment tube. The flexible harness has its ends secured to the alignment tube and the handle assembly on the impact rod. The length of the harness is adjusted so that the impact rod cannot be removed from the alignment tube while the harness is secured to the two.

For transportation purposes, a locking mechanism is provided which secures the impact rod to the alignment tube. The preferred locking mechanism is a bolt which is screwed through the alignment tube to engage the impact rod. This locking mechanism prevents any relative motion between the two elements and allows the assembly to be easily carried to a new site.

During use, a pair of handles located on the alignment tube are used to reposition the assembly. The assembly is simply lifted from its current trench and repositioned in line with the existing trench leaving an inch or two overlap.

In one embodiment of the invention, a plate at the top of the blade prevents the blade from being driven too deeply into the soil; another embodiment allows the plate to be positioned along the face of the blade to provide a depth limiting gauge.

This trencher is a manually operated, pile-driving type, hand tool designed to open a channel in the ground surface of various depths and various widths for placement of wires, cables, and others material. The "Power Trencher" is used in place of conventional wire burying machines and manual hand tools such as shovels, picks, and one piece handle blades. The trencher has an axially moving impact member guided telescopically by a mating guide member.

While a variety of specific structures are contemplated, the following is the preferred arrangement:

A) The impact member is a massive elongated rod, having a length, in the order of, 34 inches or greater, a diameter, in the order of, 1⅞ inch or greater, and comprised of impact-resistant heavy material such as steel to have a weight in the order of 33 pounds or greater;

B) The guide member is a rigid hollow outer sleeve having a slidable fit over the massive rod and having a lower end formation of internal shape corresponding to the shape of the external lower end of the impact member;

C) Attached, by means such as welding, to the lower portion of the guide member is an impact-resistant material, such as steel, in the order of 5/16 inch thickness or greater and measuring 20×9 inches or greater and reinforced, by means such as welding, with material such as steel;

D) The massive rod and guide member are cooperatively dimensioned so that the massive rod protrudes to enable a worker to alternately retract the massive rod and propel it against the lower impact section of the guide member thus forcing the blade portion of the tool into the surface of the ground.

The tool so configured provides an inexpensive, practical, efficient, safe mechanism capable of delivering very heavy, repeated blows and in a guided manner.

The invention is economical enough to address a variety of markets which have been omitted by the existing tools. This includes the tool house suppliers of every cable television operation, telephone service operation, electrical contractor, and also suitable for low cost rental from tool rental businesses that service the above mentioned industries and including landscape service companies as well as the home owner.

According to one important aspect of the invention, the new tool, which is of the known telescopically guided impact type, comprises a novel impact member in the form of a massive elongated rod having a length of for instance of 34 inches or greater and a diameter of 1⅞ inch or greater and comprised of impact-resistant, heavy material such as steel with a weight in the order of 33 pounds.

Atop the massive elongated rod is a shock-absorbing unit, attached by means such as welding and reinforced by structural units such as gussets. The shock absorbing assembly is comprised of a flexible material such as urethane encased in a durable housing comprised of a rigid strong material such as steel and being of a square cross-sectional configuration measuring 3 inches and being, for instance, 4 inches in length. A permanent adhesive material secures the flexible material to the inner walls of the housing.

A round channel in the order of ¾ inch is formed in the center of the flexible material to allow for the installation of a round bar, solid in construction, and consisting of heavy rigid material, such as steel, and being in the order of ¾ inch in diameter and, for instance, 15½ inches in length. This round bar protrudes evenly from each outer side of the flexible material a distance in the order of 5¾ inches to form operating handles.

Each of the 5¾ inches exposed round bars are sheathed with a hollow tube of corresponding length and diameter and consisting of an electrically non-conductive material such as, for instance, plastic and secured on the outer most surface of the round bar. This hollow sleeve, encasing the round bar, causes the operating handles of the massive elongated rod to turn freely in the hands of the operator. An impact-cushioning material, such as for instance nylon, covers the hollow tube sleeves to further remove vibration from the operating handles.

According to another important aspect of the invention, the new tool, uses a guiding section in the form of rigid hollow member having a lower end formed in a shape which corresponds to the lower end of the massive elongated rod. The rigid hollow member is comprised of heavy material such as steel having a length, for instance, of 30 inches and a diameter of, for instance of 2⅜ inches.

Transportation handles are comprised of heavy material, such as steel, and are shaped, for instance, in a triangular design to allow for several possible position of handling the tool during transport.

Near the top of the guiding member of the tool is a drilled hole in the order of, for instance, ½ inch. Fastened to the outside of the rigid hollow guiding member and aligned to the drilled hole, by means such as welding, is a threaded device such as a hex nut measuring, for instance, ½ inch inside diameter.

Inserted into the threaded device is a retaining unit in the order, for instance, a ½×1 inch bolt with a measurement of, for instance, ¾ inch at the head. Tightening of the retaining unit into the threaded device allows for contact through the guiding member to the impact member which locks the two to each other and serves to avoid injury to the operator during tool transport (e.g. by preventing the massive rod from being dislodged from its guide member).

Attached to the lower end of the rigid hollow structure known as the guide member, by means such as welding, is a trenching blade consisting of heavy material such as steel and measuring, for instance, 20 inches in length and, for instance, 9 inches in height. The trenching blade is of a thickness of, for instance, 5/16 inch and is sharpened on the bottom by means such as burning, milling or grinding, to an angle of, for instance, 30–45 degrees.

To reinforce the assembly of the trenching blade to guide member two pieces of heavy structural material such as steel angle iron are used. The material, such as angle iron, is, for instance, 5/16 inch thickness and 20 inches in length. The structural reinforcement material is attached to the trenching blade and to the guiding member by means of welding. To further reinforce the lower end of the tool assembly, two structural reinforcements such as gussets are attached by welding to the area adjacent to the guide member and to the combination trench blade and aforementioned structural reinforcement material.

These structural reinforcements add necessary strength to the invention to ensure durability of the tool and the safety of he operator.

Another feature of the invention is an upward movement stop. This external, visible, inspection-friendly safety device consists of material such as nylon sling or strap material, and measures, in the preferred embodiment, 1 inch in width and 39 inches in length. The two ends of the safety device are securely bound by means such as sewing with an overlap stitching surface in the order of 3 inches.

An attachment device, known as a threaded chain link or quick link, is utilized at each end of the safety strap to provide a quick link. The safety strap with its attachment devices are coupled to the shock absorber atop the elongated rod and to the side of the guide member by means of a chain link fastened by welding.

The safety strap acts to prevent the massive rod from being dislodged from the guide member during the retracting stroke of operation, thus preventing injury to the operator.

The unit has a number of advantages which may not be readily apparent, further leading to safety in operation, safety in handling in closed position, and efficiency in the commission of burying cables, wires, and other materials.

Safety in operation is gained by the massive elongated rod shape of the impact member. By this construction, the mass can be distributed uniformly over the length of the device therefore no mass concentration is required at any particular point along the length. This balance of mass also makes transport of the device less hazardous although caution and consideration by the worker are always necessary to prevent injury.

The external safety strap and the external tightening safety bolt are simply superior to the previous designs utilized in impact tools. Complicated, fancy, hidden devices will injure an operator without warning when they malfunction; visual inspection of all safety devices is mandatory in order to prevent injury.

The device also allows the operator to stand erect during operation thus lessening the risk of back injury so common in underground construction.

The device allows a worker to position the trench blade in the exact location of work to be done and then drive the blade into the ground using a periodic side to side motion to open the trench to the desired width and then reposition the blade to continue the trench with exactness and efficiency.

The shock absorbing handle assembly comprised of urethane plastic and anti-shock handle grips clearly surpass any previously manufactured tool of similar design.

Also, a rubber sound baffle is positioned around the impact member so that the top of the alignment tube is "closed" during impact, thereby muffling the sound of the impact. This significantly decreases the sound of impact emanating from the guide member to protect the hearing of the operator.

In use, the operator loosens and removes the safety bolt from the guide member after positioning the device at one end of the desired trench line. The operator then lifts the driver bar by the rotating handles and powers it downward making contact with the trench blade assembly. After every other impact, the operator moves the device from side to side, thus opening the trench to the desired width. After the desired depth and width have been accomplished, the operator lifts the device by means of the lower triangular handles and places it forward in alignment with the previously dug channel and repeats the process. When the full length of the trench is open, the material to be buried is laid in the bottom of the trench; the trench is then pushed together from each side with the boot of the worker and stamped down to even level.

The present invention is handled easily by one person and provides an imminently practical tool that has safe, dependable features. It is simply fabricated and lends itself readily to high volume production for inexpensive manufacture.

The safety features of the invention's arrangements are:

(1) Prevents injury to feet and legs because the telescopic impact design of the tool does not require dangerous motion such as swinging a pick or blade toward the ground surface;

(2) Prevents injury to back because the operator stands upright instead of leaning over constantly;

(3) Prevents injury to eyes because the digging area is at a maximum distance from facial area.

For the worker, the portability and versatility of the resent invention save time and money.

(1) Saves time—Allows for job completion on the first trip when heavy machines are impractical or impossible to use and conventional tools are too inaccurate and inefficient; and, (2) Saves money—Making useless trips to a job site wastes time; as most workers are paid on a commission basis, and operate personal vehicles, fuel costs are a major factor pertaining to net earnings; towing a burial machine to the job site adds to fuel expense. All jobs should be done on the first trip.

Since the channeling and burying of the cable/wire is accomplished before the worker leaves the site, the site is much safer. No exposed wires are left for a later trenching operation so that potential injuries to children who might trip over exposed wire are totally avoided. Further, no damage to unburied or exposed cables and wires can be done which would cause interruption of television or telephone service to consumers leading to dissatisfaction with service performance.

The simplicity of the apparatus allows its operation by an inexperienced worker

Due to "minimal impact to the environment", restoration time and damage to work area is minimized. The operator of this invention simply splits the ground's surface and subsurface, allowing for wire, cables or other material placement at required depth, without actually removing any soil or sub-soil from the trench. Closure of the trench is accomplished by pressing the ground together with the worker's foot from each side and then tamping straight down on the surface with the worker's foot or by means of a hand-type tamper. Completed closure of the trench leaves virtually no evidence of surface disturbance.

The invention allows for inexpensive, safe and efficient operation in the commission of burying cables or wires by a worker with limited experience. Also, the invention, through applicable design and safety factors protects the operator from accidental injury.

The invention, together with various embodiments thereof, will explained in more detail by the accompanying drawings and following description.

DRAWINGS IN BRIEF

DRAWINGS IN DETAIL

The arrangement of the preferred embodiment is shown in FIGS. 1–7. Those of ordinary skill in the art readily recognize variations which can be made to weights and dimensions to meet specific needs and job requirements.

Figure 1:
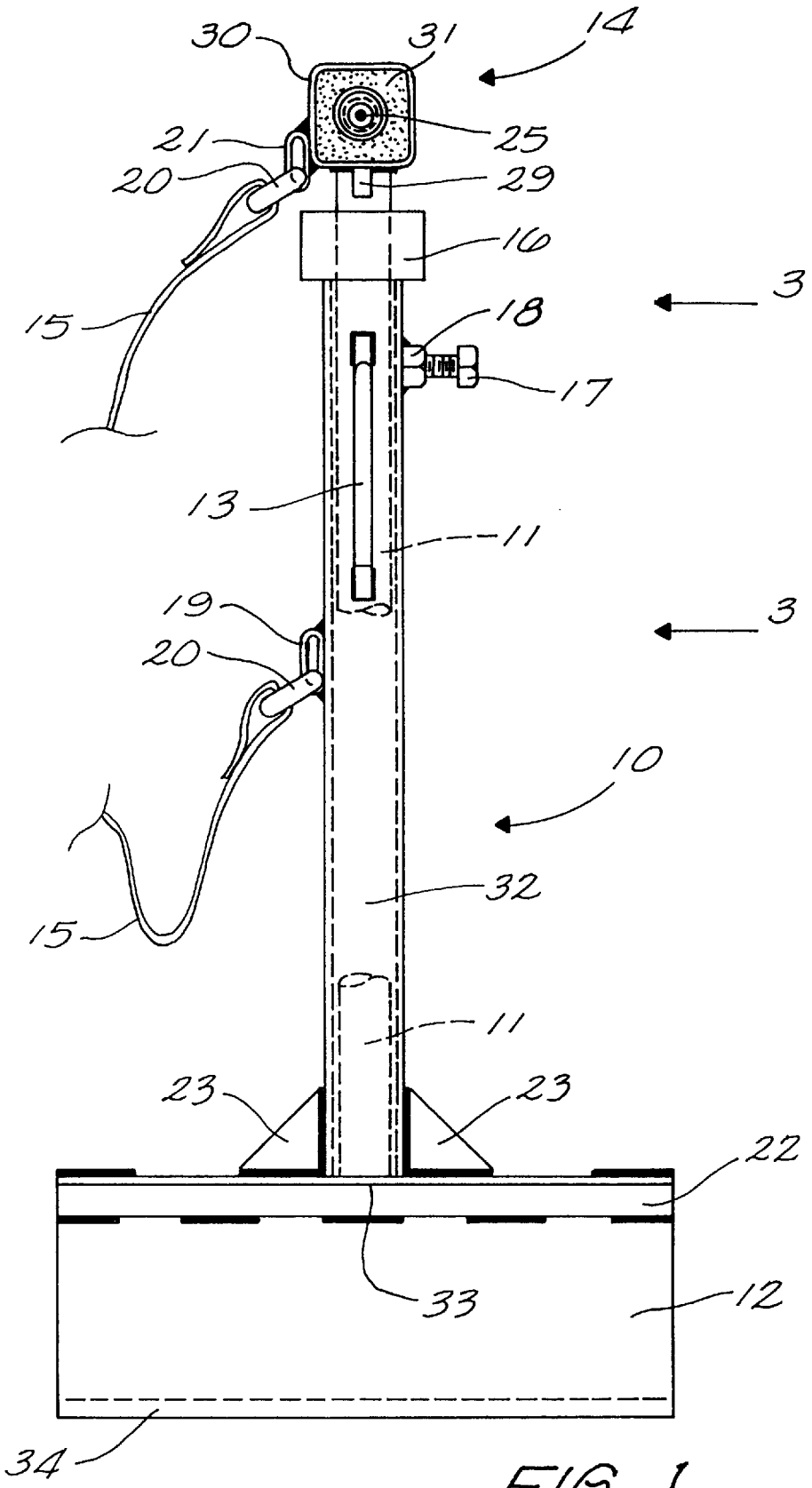
FIG. 1 is a side elevational view of the preferred embodiment of the trencher in the collapsed impact position of the device.
Figure 2:
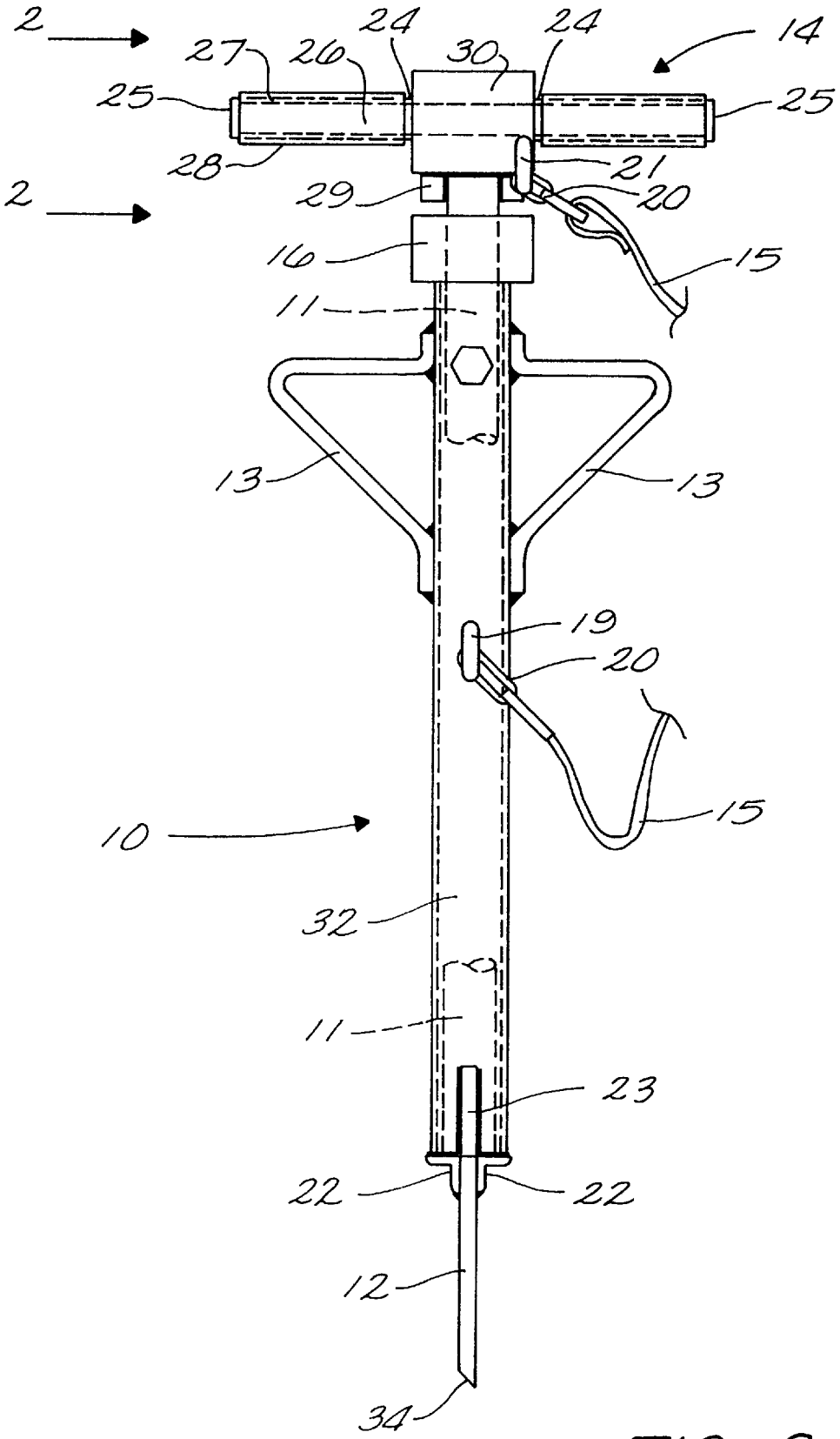
FIG. 2 is a front elevational view of the device in a collapsed impact position.
Figure 3:
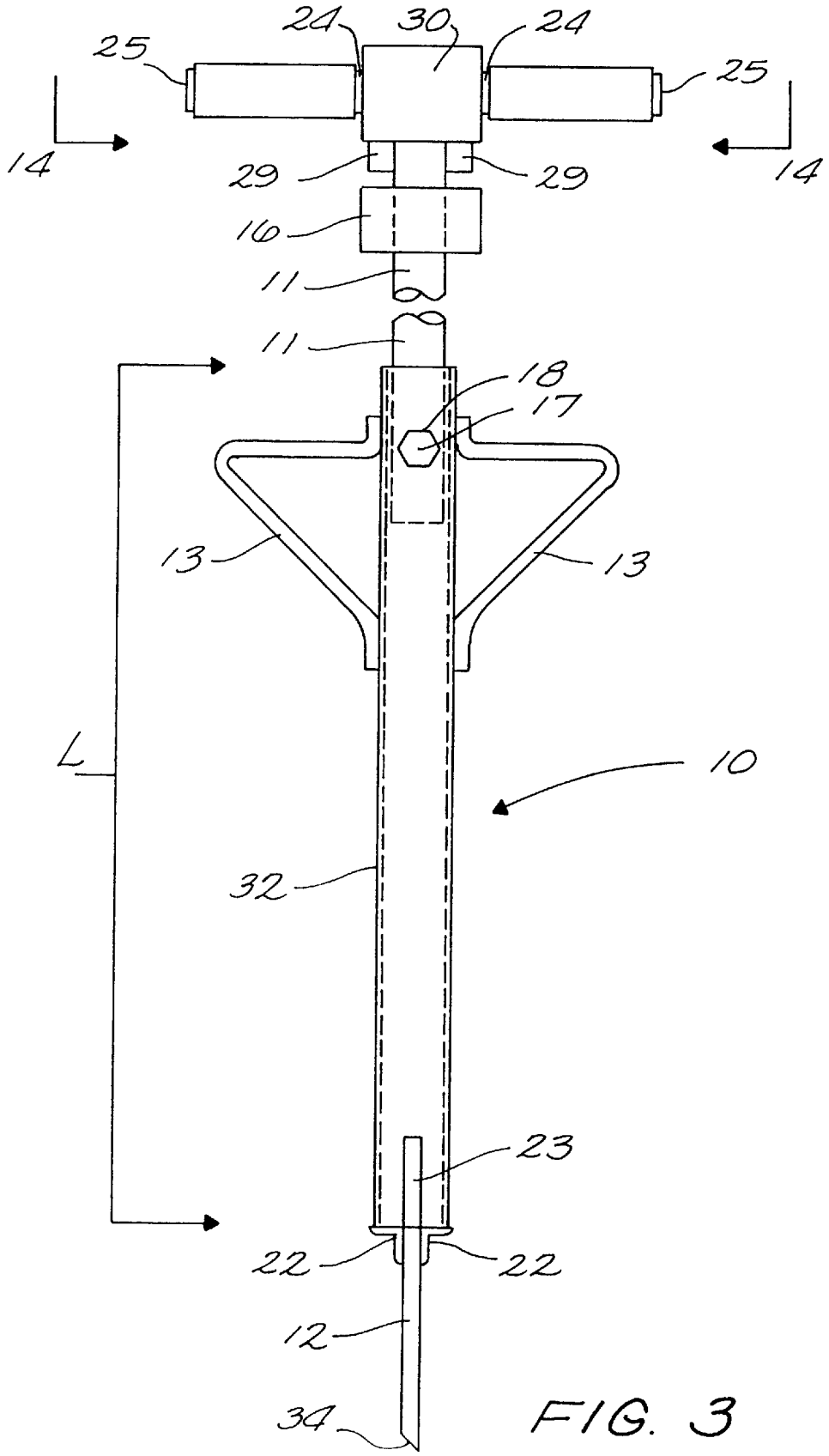
FIG. 3 is a rear elevational view of the device in the extended power-up position.

With reference now to the drawings, and in particular to FIGS. 1, 2 and 3: the preferred embodiment of the trencher is generally designated by the reference numeral 10.

Figure 4:
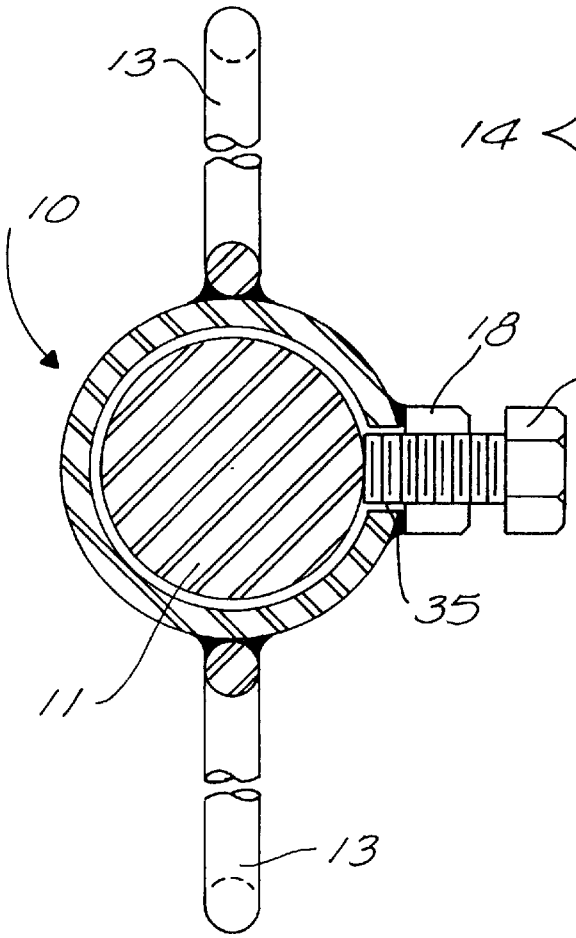
FIG. 4 is a top cross-sectional view taken along line 3—3 of FIG. 1 showing the safety lock device of the invention.
Figure 5:
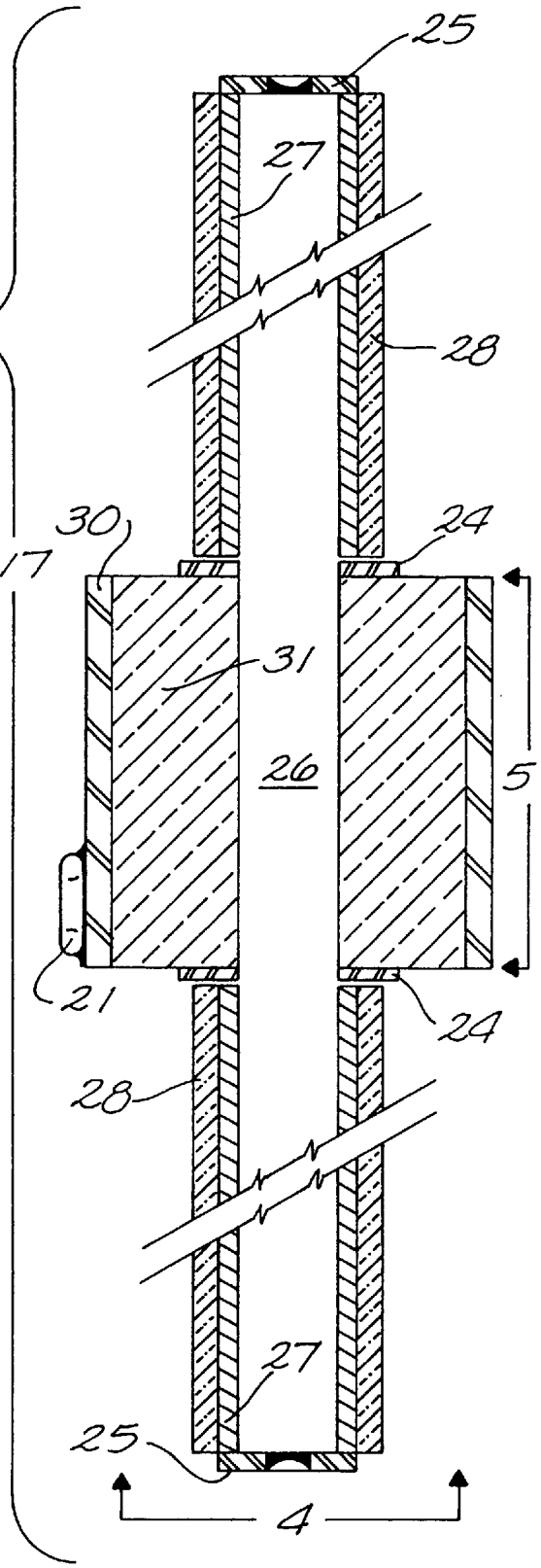
FIG. 5 is a top cross-sectional view of the anti-shock, swivel handle assembly shown in FIG. 2 and designated by numeral 14.
Figure 6:
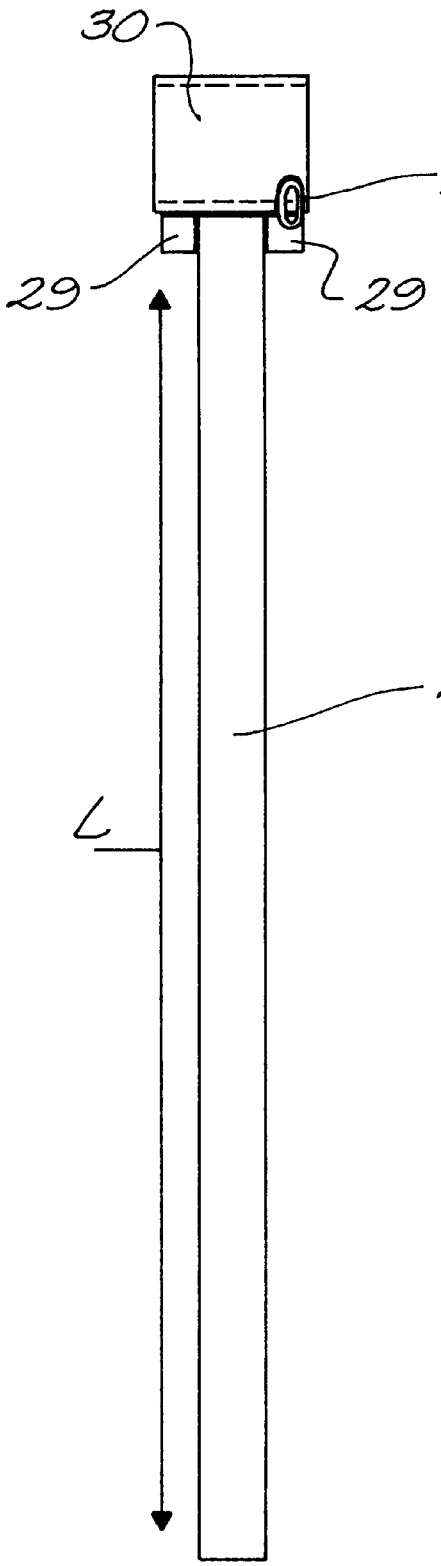
FIG. 6 is a front elevational view of the driver bar and shock-absorbing handle housing.
Figure 7:
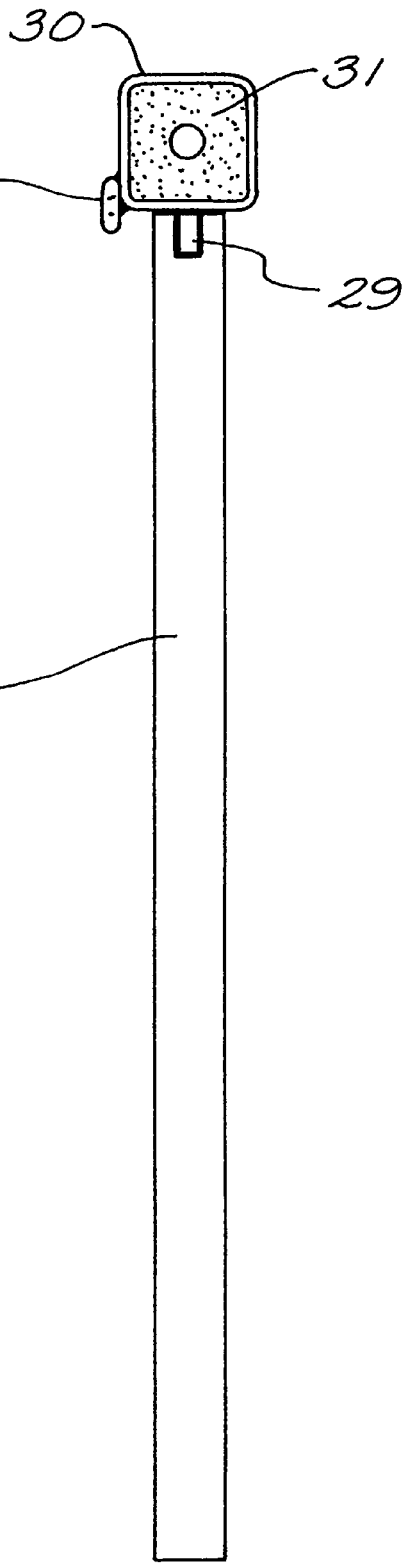
FIG. 7 is a side elevational view of the driver bar and shock-absorbing handle housing.

Specifically it will be noted in FIGS. 1 through 7 that the present invention is a new one piece, impact-style, cable and wire burying device 10. In its broadest context, the device includes a massive impact member 11 consisting of a steel rod of constant cross section of 1⅞ inches outside diameter, and has an overall length L, as seen in FIG. 6, of 34 inches and a combined weight of 33 pounds, and shall be referred to as the driver bar.

As shown in FIGS. 2, 3 and 5, a shock absorbing handle-bar assembly 14 is attached to the upper end of the driver bar 11. This assembly consists of a square steel tube 30 measuring 3 inches by 3 inches, 4—4 as shown in FIG. 5, and measuring 4 inches in length, 5—5 as shown in FIG. 5. This steel tube, known as the shock absorber housing 30, contains a substance, of shock absorbing nature, such as urethane 31 which is bonded to the inside walls of the shock absorbing housing 30. This urethane 31 is rated at a density of 60, as measured by durometer, and is the primary shock-absorbing element in the device 10.

A round solid steel bar 26 is positioned through the center of the urethane shock-absorber 31 as shown in FIG. 5. Around the outer exposed portions of the steel bar 26 are install plastic pipe sleeves 27 which are isolated by a large inner washer 24 and a smaller outer washer 25. The outer washer 25 is welded to the solid steel bar 26 in the fashion of a plug weld.

As shown in FIG. 5, the plastic pipe sleeves 27 are covered with an anti-shock material 28 as to form handle-bar grips. It is important to note that as the worker operates the tool, the handle-bar grips rotate in the operator's hand and are adequately cushioned, adding to the ease and comfort of operation.

As shown in FIGS. 1, 2 and 3, the attachment of the shock-absorber housing 30 to the driver bar 11 is reinforced by 2 gussets 29; square in shape and uniformly welded to the assembly for additional structural strength. A rubber baffle 16 is positioned around the driver bar 11 in a non-secured fashion but with a very tight fit for a sound deterring purpose. The rubber baffle 16 automatically seals the area between the driver bar 11 and the lower guide member 32 muffling the striking sound of impact caused by the driver bar 11 contacting the impact point of the guide member 32 and blade reinforcement assembly 12 and 22 as the driver bar 11 is thrust downward.

As shown in FIG. 3, the guide member 32 has an overall length of 30 inches L, and an inside diameter of 2 1/16 inches.

It is formed of hollow steel pipe having a wall thickness of 3/16 inches or greater. So constructed, the guide member 32, has great resistance to bending, being of great importance in the use of the device 10. As shown in FIGS. 1, 2 and 3, the lower end of the guide member 32 is welded to the trench blade assembly 12 and 22. The trench blade 12 has an overall length of 20 inches or greater and is formed of steel plate, flat in nature, and being of a thickness of 5/16 inch or greater. Blade 12 is provided with a sharp lower edge 34 formed at a 45 degree angle or greater. This angular edge 34 adds greatly to the trenching effectiveness of the device 10 allowing for quick, easy penetration, regardless of soil conditions, which impacted into the ground.

As shown in FIGS. 1, 2 and 3, trench blade 12 is reinforced by two annular flanges 22. These annular flanges 22, consist of angle iron, measuring the same length as the trench blade 12 and being 1¼ inches in design and having a thickness of 5/16 inch and reinforce the lower section of the device 10, specifically the impact point 33 above the trench blade 12 and the angle flanges 22.

To further reinforce the impact point 33 of the guide member 32 and the trench blade assembly, 12 and 22, two structural units are welded to the guide member 32 and adjacent surface area of the trench blade assembly 12 and 22. These units are known as gussets 23 and are of the shape of right measure three inches by three inches or greater and have a thickness of 5/16 inch or greater. The guide member 32 combined with the trench blade assembly 12 and 22 have a combined total weight of 29 pounds.

As shown in FIGS. 1 and 4, a safety locking device, 17 and 18, is welded to the upper section of the guide member 32. This safety lock device, 17 and 18, consists of a ½ inch hole 35 drilled though the guide member 32 with a ½ inch hex nut 18 welded to the guide member corresponding to the drilled hole 35.

A hex bolt 17 measuring ½ inch in diameter and 1½ inches in length, and being of a high strength rating such as a grade 8 rating, is threaded into the hex nut 18 and is selectively tightened with an appropriate tool, such as a wrench or pliers, forcing the safety bolt 17 to become tightly compressed against the driver bar 11 having passed through the ½ inch hole 35 in the guide member 32 and become secured in the ½ inch hex nut 18 by means of clockwise rotation of the hex bolt 17. This operation serves to lock the driver bar 11 into the guide member 32 when the device 10 is not in use and especially during transport preventing unexpected weight shifting in device 10.

It is important to note that this external, visible means of locking the device 10 into a stationary position is an improvement over the prior ar because this mechanism is not internal and therefore capable of being inspected regularly to insure the safety of the operator.

As shown in FIGS. 2 and 3, the guide member 32 is equipped with two handles 13 used to transport the device 10. These handles 13, being of a triangular configuration and being constructed of round steel bar measuring ⅜ inch or greater diameter are welded to the guide member 32. These lower handles 13 are used to lift the device 10 when position the tool for impact and also to transport the device 10 from job location to job location.

As shown in FIGS. 1 and 2, a safety strap 15 (a flexible harness) formed of heavy nylon and being of a one inch width or greater and having a length of thirty-nine inches or greater is secured to the guide member 32 by means of an attachment device such as a chain link 19 which is welded to the guide member 32. The opposite end of the safety strap 15 is secured to the shock-absorber housing 30 by means of an attachment device, such as a quick link 20 which is coupled to a chain link 19 that is welded to the shock-absorber housing 30.

When the driver bar 11 is at full upward extension, as shown in FIG. 3, safety strap 15 is also at full extension, disallowing the driver bar 11 from becoming dislodged from the guide member 32. It will be understood, through examination of the prior art, that the external safety strap 15 is as effective and much safer than the internal devices previously used. A visual and physical inspection of the safety strap 15 is a sufficient means of determining whether or not the device 10 is safe to operate. Previous mechanisms have been housed internally and have been impossible to inspect without disassembling the tool. Faulty internal safety devices can go unnoticed until they break which can result in injury to the operator.

In view of the heavy weight of the driver bar 11 and its ability to injure the operator of the device 10 if pulled completely out of the guide member 32, the external safety strap is a clear improvement over previous safety devices used on tools with the slide-bar motion design.

Figure 8A:
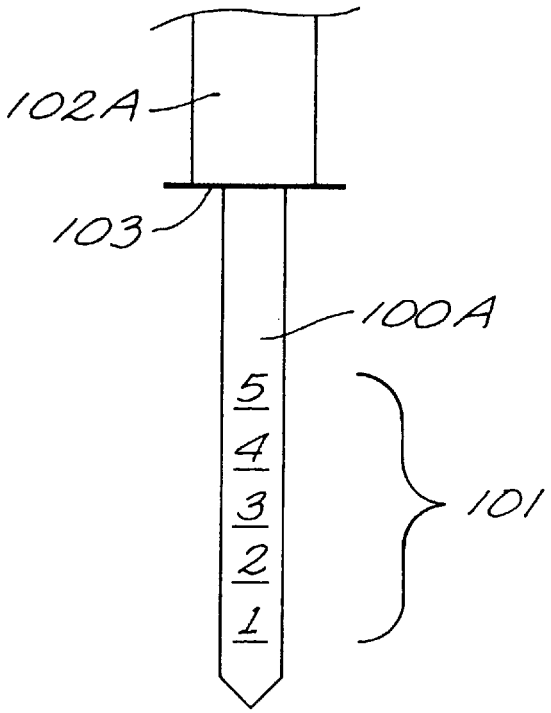
FIGS. 8A and 8B are side views of alternative embodiments of the blade member.
Figure 8B:
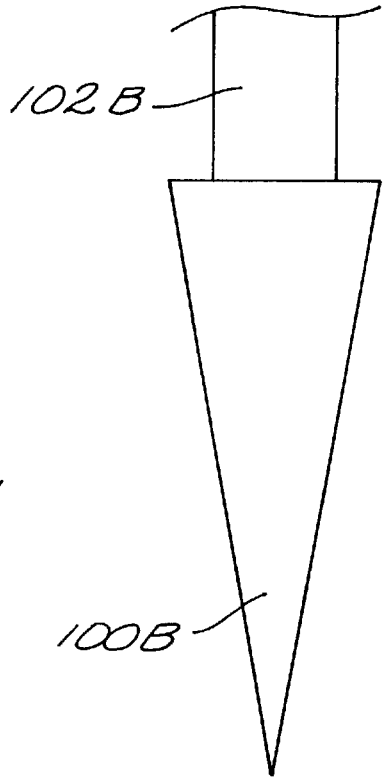

FIGS. 8A and 8B are side views of alternative embodiments of the blade member.

Referencing FIG. 8A, alignment tube 102A is secured to the top edge of blade member 100A. In this embodiment, blade 100A is a flat planar member having inscribed on an edge, indicia 101 of the depth acquired. In this manner, the operator merely needs to glance at the edge of the blade to obtain a gauge on the depth of the blade into the soil.

Depth limiting plate 103 prevents the blade from being forced into the soil too deeply.

In FIG. 8B, alignment tube 102B is secured to blade 100B which has a triangular cross section. This shape is beneficial as it assists in forming the trench without the rocking motion of the apparatus discussed earlier.

Figure 9:
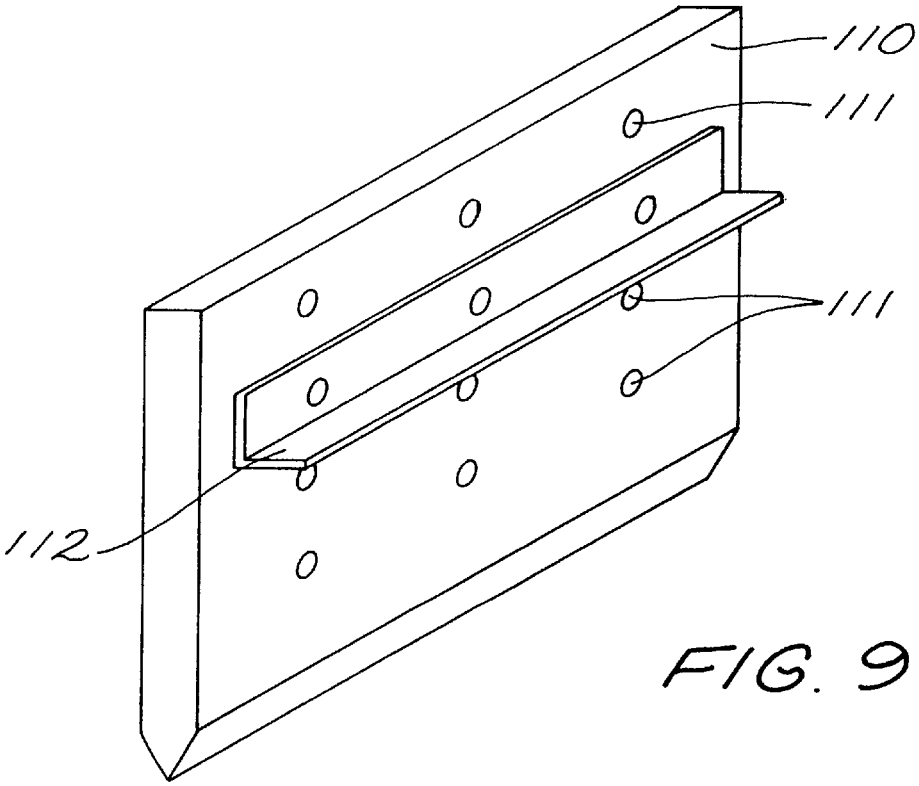
FIG. 9 is a perspective view of an alternative embodiment of the blade member illustrating the variable depth limiting mechanism.

FIG. 9 is a perspective view of an alternative embodiment of the blade member illustrating the variable depth limiting mechanism.

In this embodiment, blade 110 has a series of holes, such as holes 111, which are at varying depths and which permit limiting plate 112 to be selectively secured, via bolts, to blade 110. This embodiment permits the user to trench to the required depth without having to monitor his progress.

It is clear that the present invention creates a highly improved portable and manual trenching tool.

What is claimed is:

1. A manual trencher comprising:

a) a lower portion having, 1) a blade member adapted to be driven into soil, and, 2) an alignment tube vertically attached at a first edge to said blade member;

b) a driving member having, 1) a weighted impact member slidably engaging said alignment tube such that a first end of said weighted impact member contacts a portion of the first edge of said blade member, and, 2) an operator handle member attached to a second end of said weighted impact member; and, c) a sound block encircling said weighted impact member and engaging said alignment tube, wherein the sound block comprises a rubber baffle encircling the weighted impact member in a non-secured fashion but with a sealingly tight fit for sound deterring purpose.

2. The manual trencher according to claim 1, wherein said alignment tube includes locking means for selectively securing said lower portion to said driving member.

3. The manual trencher according to claim 2, wherein said locking means includes a bolt extending through said alignment tube and adapted to selectively engage said weighted impact member.

4. The manual trencher according to claim 1, further including a flexible harness member having a first end secured to said lower portion and a second end secured to said driving member, said harness member adapted, when secured to both said lower portion and said driving member, to prevent said weighted impact member from disengaging said alignment tube.

5. The manual trencher according to claim 1, further including a pair of positioning handles secured to opposing edges of said alignment tube.

6. The manual trencher according to claim 1, wherein said blade member has a planar cross section.

7. The manual trencher according to claim 6, wherein said blade member includes a depth gauge indicia positioned along an edge of said blade member.

8. The manual trencher according to claim 7, wherein said blade member includes a plate secured along a top edge of said blade member.

9. The manual trencher according to claim 1, wherein said blade member has a triangular cross section.

10. The manual trencher according to claim 1, further including a shock absorber interposed between said operator handle and said weighted impact member.

11. The manual trencher according to claim 10, wherein said operator handle includes cushioned grips.

12. A trenching apparatus comprising:

a) a blade portion having planar blade member secured to an alignment tube;

b) a manually actuated impact member slidably engaged with said alignment tube and adapted to impact said blade portion; and, c) a sound block encircling said impact member, wherein the sound block comprises a rubber baffle encircling the weighted impact member in a non-secured fashion but with a sealingly tight fit for sound deterring purpose.

13. The trenching apparatus according to claim 12, wherein said alignment tube is attached at right angles to an upper edge of said planar blade member and at a substantially center location of said upper edge.

14. The trenching apparatus according to claim 13, a) further including an operator's handle; and, b) a shock absorber adapted to secure said operator's handle to said manually actuated impact member.

15. The trenching apparatus according to claim 13, a) further including a flexible harness member having a first end secured to said blade portion and a second end secured to said impact member, said harness member adapted, when secured to both a lower portion and said impact member, to assure continuous engagement of said manually actuated impact member with said alignment tube; and, b) further including a pair of positioning handles secured to opposing edges of said alignment tube.

16. The trenching apparatus according to claim 13, a) further including a depth gauge indicia positioned along an edge of said planar blade member; and, b) further including a depth limiting plate secured along the upper edge of said planar blade member.

17. A manual trencher comprising:

a) a lower portion having, 1) a blade member being substantially planar and adapted to be driven into soil, said blade member including a depth limiting member secured thereto, 2) an alignment tube vertically attached at a first edge to said blade member, and, 3) a first and a second positioning handle secured to opposing edges of said alignment tube;

b) a driving member having, 1) a weighted impact member slidably engaging said alignment tube such that a first end of said weighted impact member contacts the first edge of said blade member, and, 2) an operator handle member attached to a second end of said weighted impact member;

c) a sound block encircling said weighted impact member and engaging said alignment tube, wherein the sound block comprises a rubber baffle encircling the weighted impact member in a non-secured fashion but with a sealingly tight fit for sound deterring purpose; and, d) safety means adapted to prevent said weighted impact member from being withdrawn from said alignment tube.

18. The manual trencher according to claim 17, wherein said alignment tube includes locking means for selectively securing said lower portion to said driving member.

19. The manual trencher according to claim 18, wherein said locking means includes a bolt extending through said alignment tube and adapted to selectively engage said weighted impact member.

20. The manual trencher according to claim 17, wherein said safety means includes a flexible harness member having a first end secured to said lower portion and a second end secured to said driving member, said harness member adapted, when secured to both said lower portion and said driving member, to prevent said weighted impact member from disengaging said alignment tube.

21. The manual trencher according to claim 17, wherein said depth limiting member includes a plate secured to the upper edge of said blade member.

22. The manual trencher according to claim 17, wherein said depth limiting member is selectively attached to a face of said blade member.

* * * * *